US007883172B2

(12) United States Patent
Hirato

(10) Patent No.: US 7,883,172 B2
(45) Date of Patent: Feb. 8, 2011

(54) INKJET RECORDING APPARATUS WITH PLURAL HEADS AND SUCTION UNIT

(75) Inventor: Katsuyuki Hirato, Shizuoka (JP)

(73) Assignee: FUJIFILM CORPORATION, Tokyo (JP)

( * ) Notice: Subject to any disclaimer, the term of this patent is extended or adjusted under 35 U.S.C. 154(b) by 954 days.

(21) Appl. No.: 11/692,428

(22) Filed: Mar. 28, 2007

(65) Prior Publication Data

US 2007/0229584 A1 Oct. 4, 2007

(30) Foreign Application Priority Data

Mar. 30, 2006 (JP) ..... 2006-095471

(51) Int. Cl.
*B41J 2/165* (2006.01)

(52) U.S. Cl. ..... 347/22; 347/30

(58) Field of Classification Search ..... 347/20, 347/22, 29–34, 44, 47
See application file for complete search history.

(56) References Cited

U.S. PATENT DOCUMENTS 5,270,738 A * 12/1993 Takahashi et al. ..... 347/24
6,481,826 B1 * 11/2002 Hara et al. ..... 347/29
2002/0140761 A1 10/2002 Tsurui
2003/0167940 A1 9/2003 Haug

FOREIGN PATENT DOCUMENTS

| | | | |
|---|---|---|---|
| GB | 2280149 | A | 1/1995 |
| JP | 4-062064 | A | 2/1992 |
| JP | 7-040540 | A | 2/1995 |
| JP | 2003-127436 | A | 5/2003 |
| JP | 2005-199465 | A | 7/2005 |
| JP | 2005-205766 | A | 8/2005 |
| JP | 2005-305972 | A | 11/2005 |
| JP | 2005-314586 | A | 11/2005 |
| WO | 00/43209 | A1 | 7/2000 |

OTHER PUBLICATIONS

Extended European Search Report.
Japanese Office Action, dated Oct. 19, 2010, issued in Application No. 2006-095471.

* cited by examiner

*Primary Examiner*—Juanita D Stephens
(74) *Attorney, Agent, or Firm*—Sughrue Mion, PLLC

(57) ABSTRACT

An inkjet recording apparatus includes: a plurality of inkjet heads having nozzles ejecting a functional liquid material on a recording medium; a head holder fixing the plurality of inkjet heads at predetermined intervals; and an ink suction unit that has a suction port disposed in the vicinity of the nozzles thereof.

8 Claims, 8 Drawing Sheets

INKJET RECORDING APPARATUS WITH PLURAL HEADS AND SUCTION UNIT

BACKGROUND OF THE INVENTION

1. Field of the Invention

The present invention relates to an inkjet recording apparatus of ejecting a functional liquid material such as ink drop on a recording medium to record an image (including letters, hereinafter the same). More specifically, the present invention relates to an inkjet recording apparatus equipped with a head unit having a mechanism of suctioning ink mist generated at the ejection of an ink drop and suctioning also ink adhered to a nozzle plate (inkjet head).

2. Background Art

The inkjet recording apparatus where a functional material (functional liquid material) curable with energy such as ultraviolet ray and electron beam is ejected on a recording medium from nozzles of an inkjet head and the functional material is cured by the irradiation of energy, thereby performing the image formation, has many characteristic features, for example, this system is environment-friendly, high-speed recording can be made on various recording mediums and a high-definition image with less blurring is obtained. In particular, development of a recording apparatus using an ultraviolet curable functional material (ultraviolet curable ink) is proceeding in view of easy handling of light source, easy downsizing and the like.

The inkjet head has a large number of nozzles and when an ejection failure of the nozzle is generated, this is visible as an image defect. The ejection failure of nozzle occurs prominently in particular when ejection from the nozzles is continued for a certain period of time. The cause thereof includes misdirected ejection, no ejection, change of ejection amount and ink dripping, for which adhering ink attributable to ink mist and attached on the nozzle plate is responsible.

In order to prevent the ink from adhering on the nozzle plate, there is known an inkjet printer where wiping, suctioning or spitting of the nozzle surface is performed while the inkjet head is located off the recording region, or volatile substances of the ink adhered to the inkjet head are removed by blowing air to the inkjet head or suctioning air in the vicinity of the inkjet head (see, for example, JP-A-2005-14560 (the term "JP-A" as used herein means an "unexamined published Japanese patent application")). Also, there have been proposed an inkjet recording apparatus where a flexible duct having a recovery port nearly flush with the nozzle surface is provided as a separate body from the inkjet head and the ink mist is suctioned together with air from the recovery port (see, for example, JP-A-2005-205766), and an image forming apparatus where an air flow in a constant direction is created in a recording device by the blowing or suctioning of air and the ink mist is trapped by the air flow (see, for example, JP-A-2005-199465).

However, the recording devices described in JP-A-2005-14560, JP-A-2005-20576 G and JP-A-2005-199465 all are a recording apparatus employing a system such that the recording is performed by ejecting an ink while transferring an inkjet head in the direction perpendicular to the conveyance direction of a recording medium, and in the case of an inkjet recording apparatus employing a single pass system using a full line head of recording an image by only once passing a recording medium beneath the inkjet head, the wiping, suctioning or spitting of head surface cannot be performed, because the head is always located in the recording region.

In the recording apparatus described in JP-A-2005-14560, volatile substances adhered to the inkjet head are removed by generating an air flow in the vicinity of the inkjet head with use of air-blowing or suctioning means disposed apart from the inkjet head, but because of distant location from the head, the effect of removing nonvolatile substances is insufficient. Nonvolatile substances are gradually accumulated in the inkjet head during a long-term use and cause an ejection failure of nozzle.

When ink mist is removed by suctioning air in the vicinity of nozzles from somewhat distant position or by blowing and suctioning air as in the recording apparatus described in JP-A-2005-205766 and JP-A-2005-199465, this sometimes incurs deterioration of the straight ejection property of ink and reduction in the image quality. Also, it is difficult to completely prevent the ink mist from adhering to the nozzle plate, and when ink mist is once attached to the nozzle plate, there is no effective means to solve the ejection failure of nozzle, for example, the ink adhered during image drawing cannot be removed.

SUMMARY OF THE INVENTION

The present invention has been made under these circumstances and an object of the present invention is to provide an inkjet recording apparatus ensuring that ink adhered to the nozzle plate during image drawing can be removed and a high-quality image can be formed at a high speed.

(1) According to an aspect of the present invention, an inkjet recording apparatus includes: a plurality of inkjet heads having nozzles ejecting a functional liquid material on a recording medium; a head holder fixing the plurality of inkjet heads at predetermined intervals; and an ink suction unit that has a suction port disposed in the vicinity of the nozzles thereof.

According to the inkjet head recording apparatus of this construction, since ink suction means having a suction port arranged every each inkjet head and disposed in the vicinity of the nozzle thereof is provided, adhesion of unnecessary ink to the inkjet head including the periphery of nozzle can be suppressed and at the same time, the ink adhered to the inkjet head can be eliminated, so that is a high-quality image can be formed by preventing misdirected ejection, no ejection, change of ejection amount and ink dripping.

(2) The inkjet recording apparatus as described in the item (1) wherein the suction port is disposed in each of the plurality of inkjet heads.

(3) The inkjet recording apparatus as described in the item (1), wherein the suction port is disposed in the head holder.

According to the inkjet head recording apparatus of this construction, since the suction port is disposed in the head holder to run in parallel with the line of nozzles, the straight ejection property of ink is not affected and air in the vicinity of the nozzle can be suctioned while ejecting the ink from the nozzle, so that a high-quality image can be formed by suctioning and eliminating the ink adhered to the nozzle plate and at the same time, suctioning the ink mist.

(4) The inkjet recording apparatus as described in the item (1) wherein the suction port is disposed at a borderline region contacting with the head holder and the each of the plurality of inkjet heads.

According to the inkjet head recording apparatus of this construction, since the suction port is disposed between the head holder and the head to run in parallel with the line of nozzles, the suction port can be disposed in the vicinity of the nozzle by a simple mechanism and the ink adhered to the nozzle plate can be suctioned and eliminated or the ink mist can be suctioned. Furthermore, when the lower surface of the head holder is projected from the lower surface of the head to form a wall on the side opposite the nozzle with respect to the suction port, the air on the nozzle side can be efficiently suctioned and the ink mist or ink adhered to the nozzle plate can be unfailingly suctioned and eliminated.

(5) The inkjet recording apparatus as described in the item (1), wherein the suction port is arranged on a member on which the nozzles are provided.

According to the inkjet head recording apparatus of this construction, since the suction port is provided integrally with the nozzle to run in parallel with the line of nozzles, the suction port can be disposed very close to the nozzle and the ink mist generated upon ejection of ink from the nozzle can be immediately suctioned and recovered even by a weak suction power and prevented from adhering to the nozzle plate. The ink adhered to the nozzle plate can also be suctioned and removed, whereby a high-quality image can be formed.

According to the present invention, an inkjet recording apparatus capable of removing ink adhered to the nozzle plate during image drawing and performing high-speed formation of a high-quality image can be provided.

BRIEF DESCRIPTION OF THE DRAWINGS

The invention disclosed herein will be understood better with reference to the following drawings of which.

DETAILED DESCRIPTION OF THE INVENTION

First Embodiment

Figure 1:
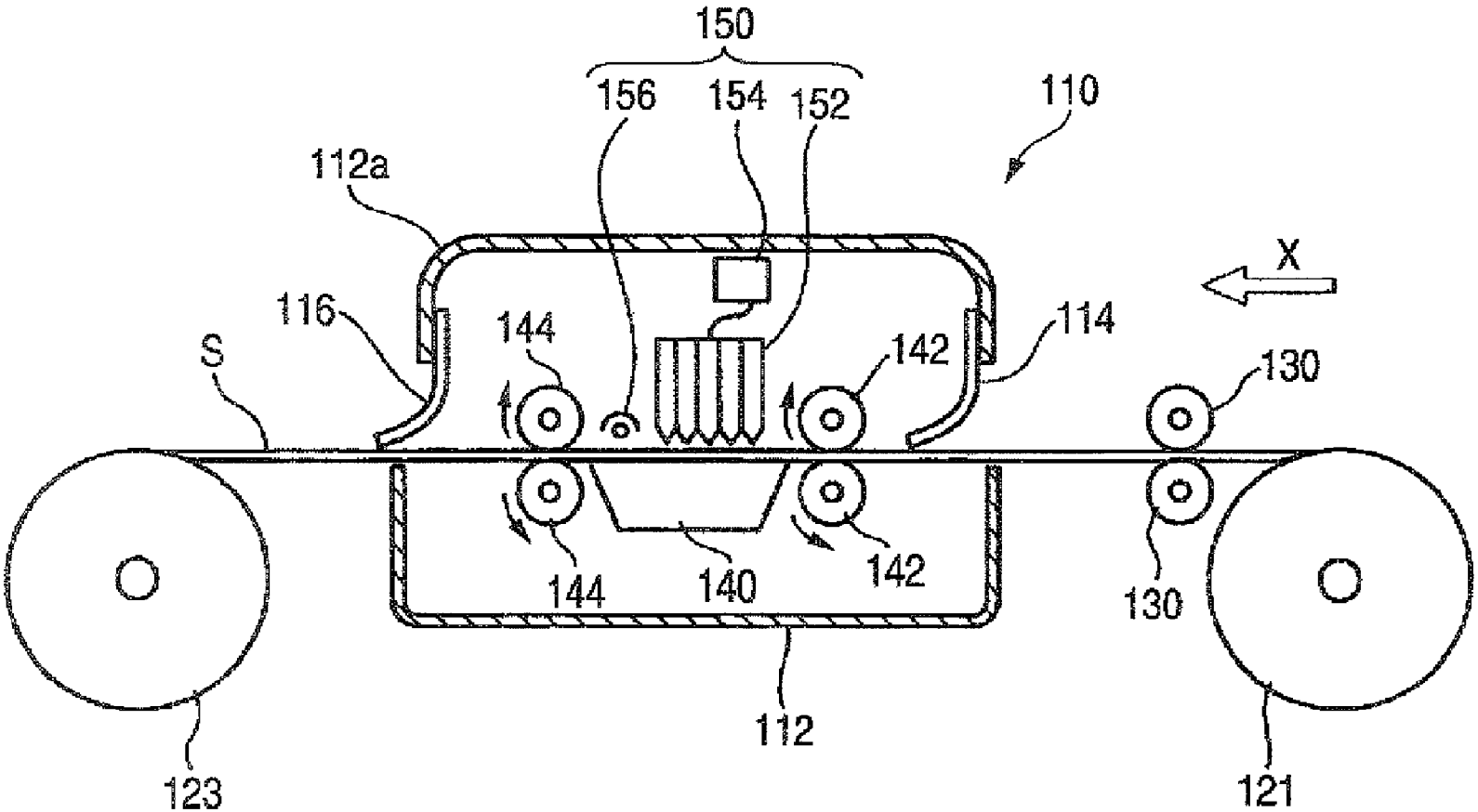
FIG. 1 is a main part perspective view showing the construction of an inkjet recording apparatus.

Each embodiment of the present invention is described in detail below by referring to the drawings.

Figure 2:
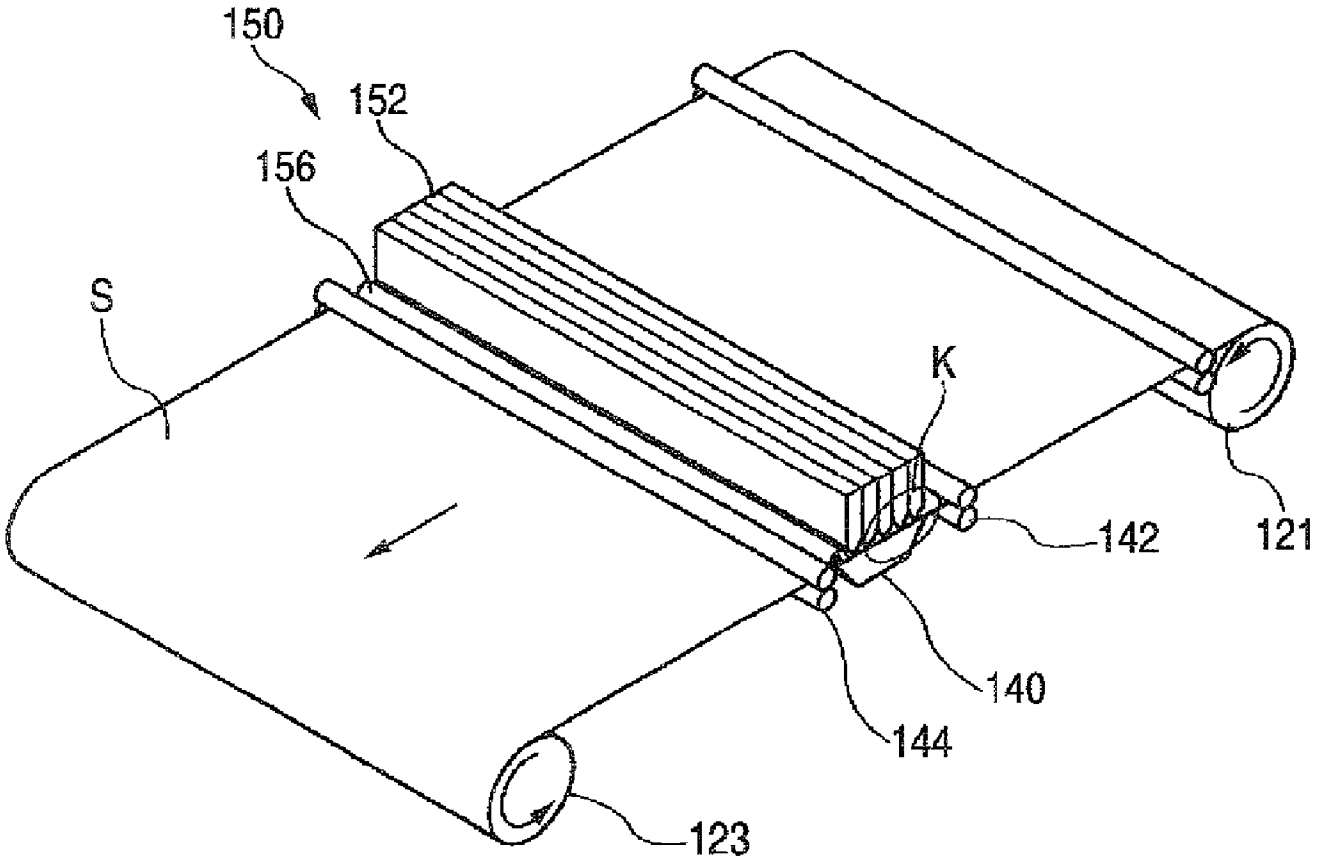
FIG. 2 is an enlarged perspective view showing the image recording part using an inkjet head in the active energy curing-type inkjet recording apparatus shown in FIG. 1.

FIG. 1 is a schematic constitutional view showing one embodiment of the inkjet recording apparatus for practicing an active energy curing-type inkjet recording method, out of the inkjet recording apparatuses according to the present invention, and FIG. 2 is an enlarged perspective view showing the image recording part using an inkjet head in the active energy curing-type inkjet recording apparatus shown in FIG. 1.

The active energy curing-type inkjet recording apparatus 110 of this embodiment uses, as the active energy curable ink, a UV curable ink which is cured by the ultraviolet irradiation.

In FIG. 1, the active energy curing-type inkjet recording apparatus 110 has a cage 112, and a recording medium S wound around a roll 121 on the delivery side is rolled out by conveyance rollers 130 and after passing through a flexible light-shielding door 114, conveyed into the cage 112. The conveyed recording medium S is fed out from a light-shielding door 116 disposed on the opposite side of the cage 112 and taken up by a roll 123 on the take-up side. The recording medium S conveyed into the cage 112 is fed on a platen 140 held by a conveying/holding roller 142. Furthermore, the recording medium S is held by conveying/holding rollers 144 disposed on the opposite side across the platen 140 and after scanning and conveyance on the platen 140, fed out from the light-shielding door 116. At the position opposing the platen 140 across the recording medium S, an image recording part 150 is disposed. In the image recording part 150, inkjet image recording and fixing by the irradiation of active energy (in this embodiment, ultraviolet light) are performed on the recording medium S during scanning and conveyance on the platen 140. An ink reservoir part for reserving ink and supplying it to the image recording part 150 through a supply line (not shown) is provided in the cage 112.

In the image recording part 150, a head unit 152 which is an inkjet head is provided by directing the distal end of its ink ejection part to the platen 140 at the image recording position. As shown in FIG. 2 described later, this is a full line-type head having an array in the widthwise length of the recording medium S and a piezo-type head is employed. The head unit 152 ejects an ink curable with active energy toward the recording medium S. A head driver 154 which is an inkjet head drive unit is connected to the head unit 152 and controls the ejection amount of each color ink. Downstream the head unit 152, an active energy irradiation part 156 is disposed. Also, an ink supply part (not shown) is connected to the image recording part 150 for supplying ink.

Figure 3:
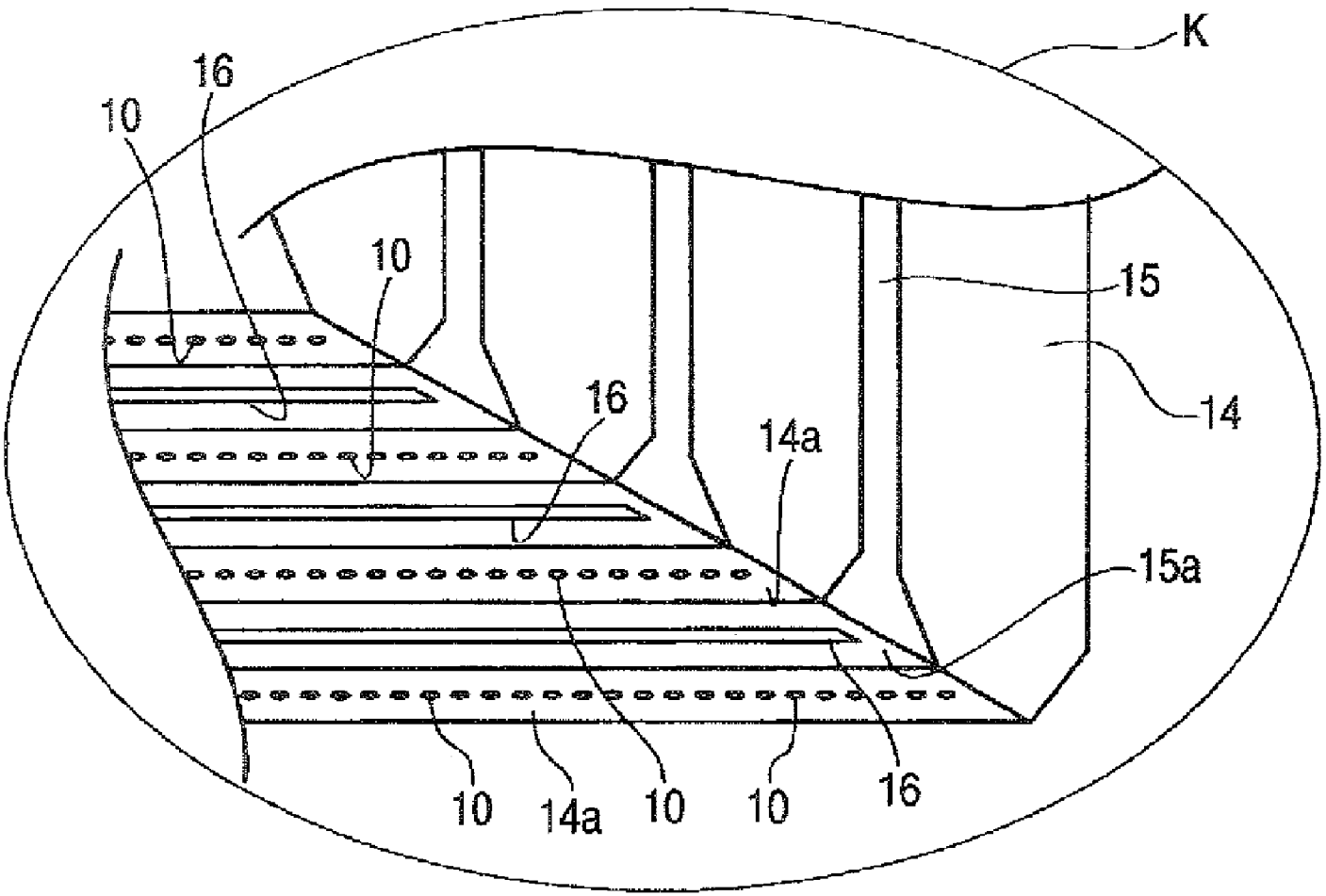
FIG. 3 is a perspective view seeing the head unit in FIG. 1 from below.
Figure 4:
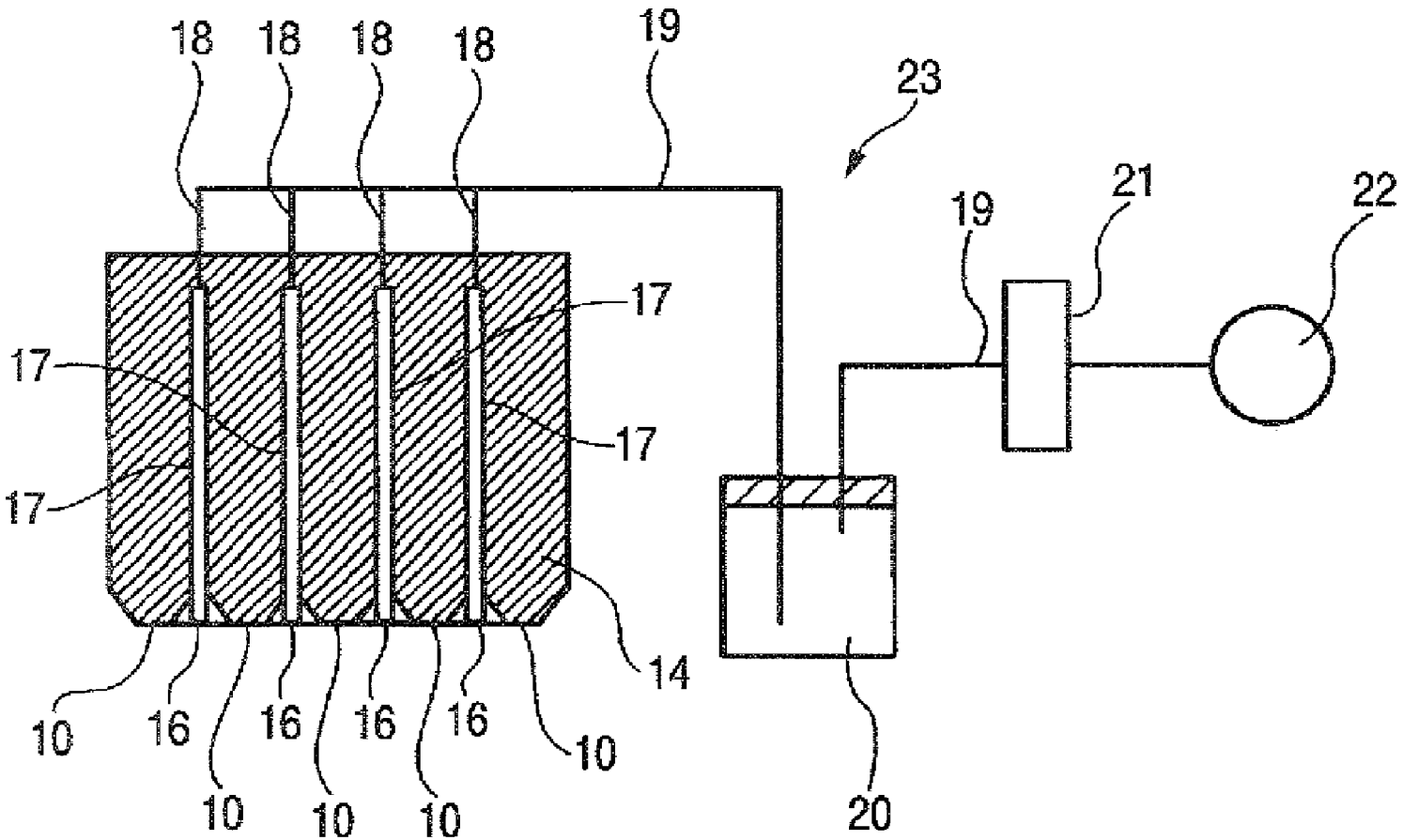
FIG. 4 is a schematic constitutional view showing the ink suction means.

FIG. 3 is a partial perspective view seeing the head unit in the range K of FIG. 1 from below, and FIG. 4 is a schematic constitutional view showing the ink suction means.

In the head unit 152, a large number of nozzles 10 are arrayed at a predetermined pitch over the entire widthwise length of the recording medium S, and a functional liquid material is ejected from the nozzles 10 to form an image on the recording medium S. Incidentally, the above-described fundamental construction of the inkjet recording apparatus 110 is a construction common in the following embodiments.

The head unit 152 of the first embodiment is an embodiment where the suction port described later is disposed in the head holder to run in parallel with the line of nozzles.

As shown in FIG. 3, the inkjet unit 152 comprises an inkjet head 14 having a large number of nozzles 10 arrayed at predetermined intervals (for example, intervals of 80 μm) and a head holder 15 for fixing the inkjet head 14. Bach nozzles 10 of the inkjet head 14 is connected to an ink tank (not shown) for reserving a functional liquid material (ink), and a functional liquid material supplied from the ink tank is ejected on the recording medium S according to the predetermined timing, whereby an image is formed. The inkjet head 14 is provided every each ink color and usually, from four to six inkjet heads 14 are held by the head holder 15. In this first embodiment, five inkjet heads 14 are provided.

In the first embodiment, the inkjet head 14 is integrally fixed to the head holder 15, and the lower surface 14*a* of the inkjet head 14 is designed to be flush with the lower surface 15*a* of the head holder 15. On the lower surface 15*a* of the head holder 15, an opening suction port 16 is disposed to run in parallel with the array direction of nozzles 10 and at the same time, come to the vicinity of the nozzles 10. Inside the head holder 15, a slit groove 17 described later is provided and connected to the suction port 16.

As shown in FIG. 41 the slit groove 17 is connected to the outside by a channel 18 penetrating through the back surface of the head holder 15. The channel 18 is, by using a pipe 19 connected thereto, connected to a suction pump 22 through a trap vessel 20 and a filter 21, thereby constructing the ink suction means 23.

The slit-like suction port 16 is formed to have a width of about 1 mm and a length slightly larger than the array length of nozzles 10 provided in the inkjet head 14. A suction port 16 and nozzles 10 come to be disposed in parallel and alternately, that is, the head holder 15 and the inkjet head 14 are integrally fixed in an arrangement of the suction port 16 being located very close to the nozzles 10. This is equal to a construction where an ink suction mechanism is incorporated into the head unit 152

The suction pump 22 is not particularly limited as long as it can generate an air volume (suction amount) of 1 ml/min to 100 liter/min, and an exhaust fan or pump in an arbitrary mode may be used. Examples thereof include a diaphragm pump (APN085LV-1) manufactured by TEM-JACK K.K.

As for the operation of the thus-constructed inkjet recording apparatus 110, the suction pump 22 is continuously actuated and while suctioning air in the vicinity of the nozzles 10 from the slit-like suction port 16, a functional liquid material is ejected at the predetermined timing from the nozzles 10 on the recording medium S moving relatively to the nozzles 10 on the platen 140, whereby an image is formed on the recording medium S.

By virtue of suctioning air in the vicinity of the nozzles 10, the fine ink mist resulting from partial separation of a liquid droplet at the ejection of the functional liquid material and floating in the vicinity of the nozzles 10 or the recording medium S is suctioned together with the air and recovered in the trap vessel 20. A part of the ink mist remaining in the air without being recovered in the trap vessel 20 is further captured by the filter 21 and therefore, the periphery of the inkjet recording apparatus 110 is not contaminated with ink contained in the exhaust air.

As described above, since the unnecessary ink mist generated is immediately suctioned from the suction port 16 and recovered, not only the image quality is enhanced but also the inside (particularly, inkjet head) of the inkjet recording apparatus 110 is prevented from contamination, whereby the ink adhesion to the inkjet head 14 (particularly, lower surface 14*a*) can be suppressed.

Even if the ink mist adheres to the inkjet head 14, the ink mist is immediately suctioned and removed from the slit-like suction port 16 disposed in the vicinity of the nozzles 10, so that the periphery of the nozzles 10 can be always kept clean and troubles such as misdirected ejection, no ejection, change of ejection amount and ink dripping, for which adhering ink attributable to ink mist and attached on the inkjet head 14 is responsible, can be prevented.

The amount of air suctioned from the slit-like suction port 16 is preferably from 1 ml/min to 100 liter/min, more preferably from 10 ml/min to 20 liter/min. If the amount of air suctioned is 10 ml/min or less, the ink mist may remain without being suctioned, whereas if the amount of air suctioned is 20 liter/min or more, this may affect the straight ejection property of ink ejected from the nozzles 10.

The functional liquid material is not particularly limited, but a functional material curable with energy such as ultraviolet ray and electron beam may be used and, for example, an ultraviolet curable functional material (ultraviolet curable ink) which is cured by irradiating the image formed on the recording medium S with an ultraviolet ray is suitably used.

Figure 5:
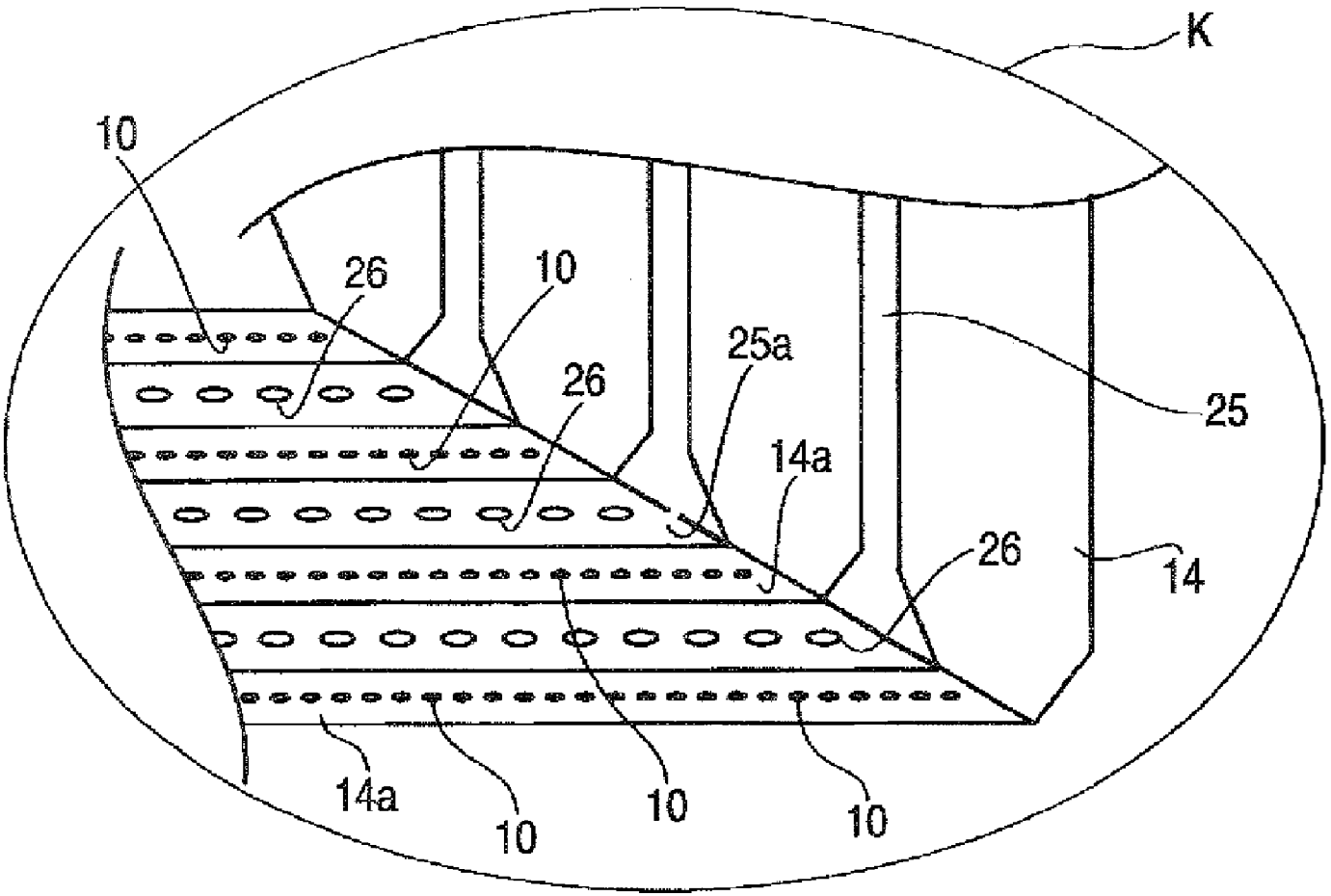
FIG. 5 is a perspective view seeing the head unit of a modified example from below.

A head holder of a modified example is described below by referring to FIG. 5. FIG. 5 is a perspective view seeing the head holder in the range K of a modified example from below. Incidentally, the modified example is different only in the suction port shape of the head holder and since other portions are the same as those of the inkjet recording apparatus 100 of the first embodiment already described above by referring to FIGS. 1 to 4, only the head holder is shown.

In FIG. 5, a modified example of the head holder suction of the first embodiment is shown and on the lower surface 25*a* of the head holder 25, instead of the slit-like suction port, a large number of suction holes 26 are formed to align in parallel with the array direction of nozzles 10 and come to the vicinity of the nozzles 10. The shape of the suction hole 26 may be freely selected but, for example, the suction holes are a small hole with a diameter of 50 μm and disposed at intervals of 168 μm. Each suction hole 26 is, similarly to FIG. 4, connected to the outside by a channel 18 through the upper portion of the suction hole 26, and the channel 18 is, by using a pipe 19 connected thereto, connected to a suction pump 22 through a trap vessel 20 and a filter 21.

By virtue of such a construction, the ink mist in the vicinity of the nozzles 10 and the ink adhered to the inkjet head 14 are efficiently suctioned and removed from the suction holes 26, and troubles such as misdirected ejection of ink, no ejection, change of ejection amount and ink dripping are prevented. Other constitutions, functions and operations are the same as those of the inkjet recording apparatus 110 of the first embodiment, and description thereof is omitted here.

Second Embodiment

Figure 6:
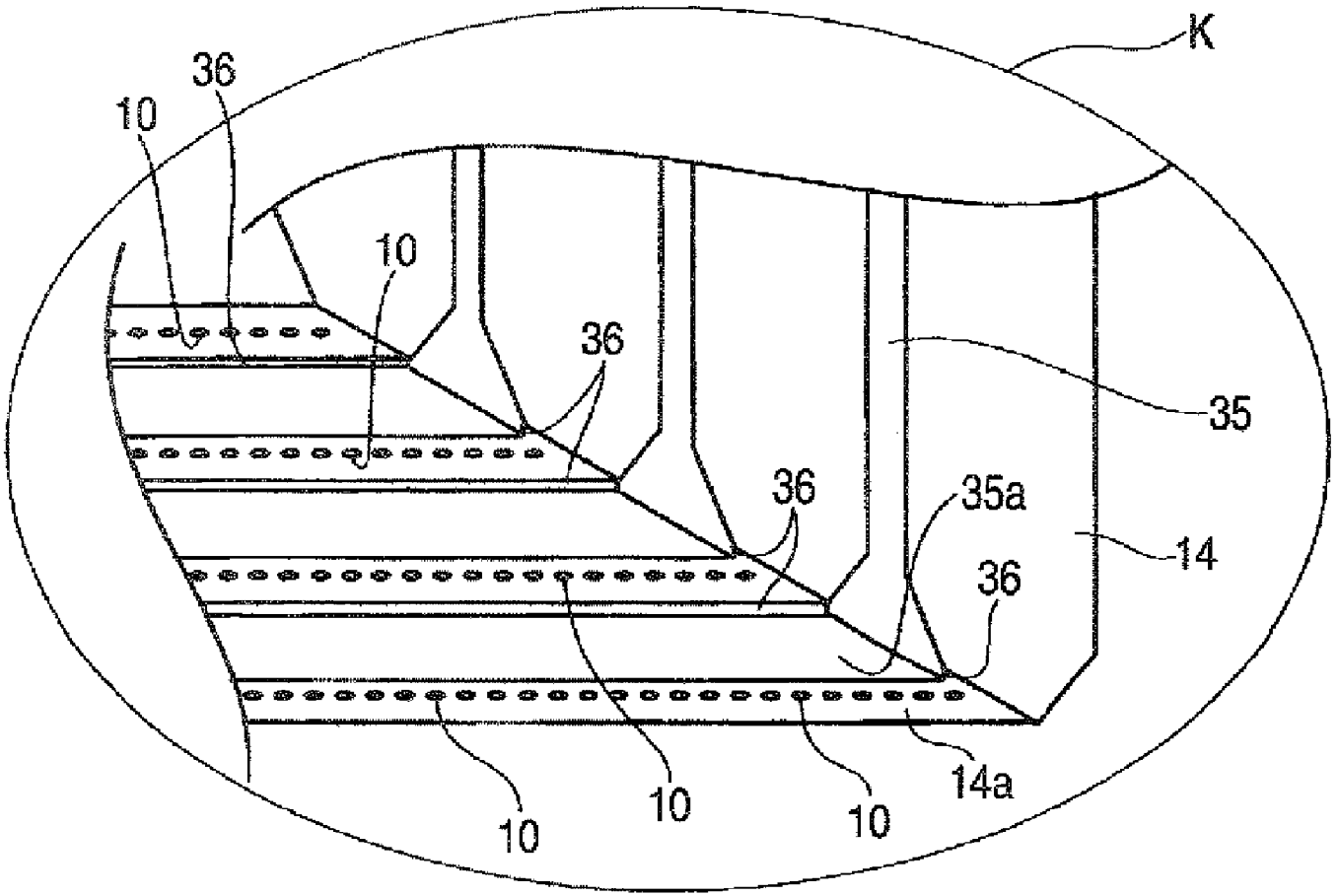
FIG. 6 is a perspective view seeing the head unit of the second embodiment from below.
Figure 7:
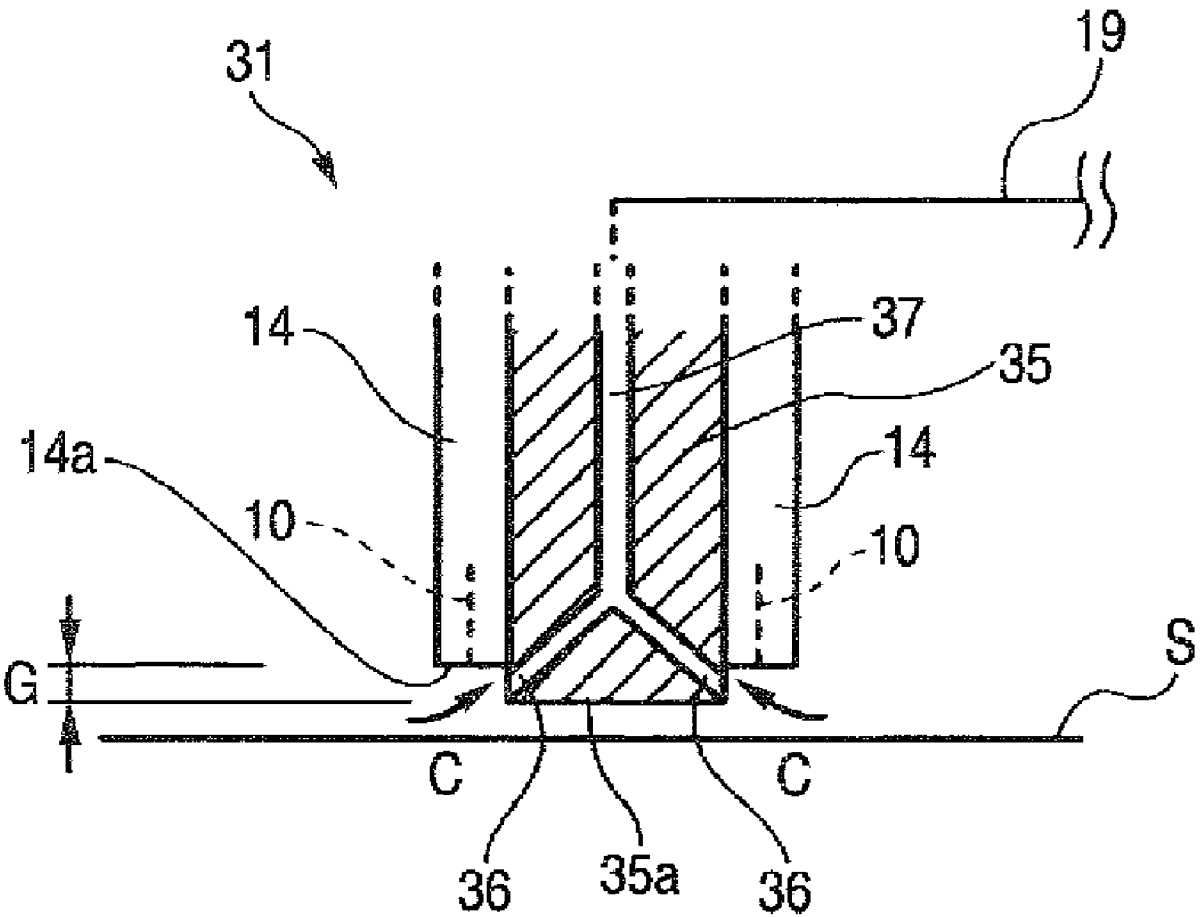
FIG. 7 is a partial sectional view showing one head holder in FIG. 6 and inkjet heads sandwiching the head holder.

The head unit of the second embodiment is described below by referring to FIGS. 6 and 7. In the head unit of the second embodiment, the suction port is disposed between the head holder and the inkjet head to run in parallel with the line of nozzles. FIG. 6 is a perspective view seeing the head unit of the second embodiment from below, and FIG. 7 is a partial sectional view showing one head holder in FIG. 6 and inkjet heads sandwiching the head holder.

Incidentally, the second embodiment is different only in the suction port construction of the head unit and since other portions are the same as those of the inkjet recording apparatus 110 of the first embodiment described above, only the head unit is shown.

The head unit 31 of the second embodiment comprises an inkjet head 14 and a head holder 35 for fixing the inkjet head 14. In the inkjet head 14, similarly to the inkjet head 14 of the first embodiment, a large number of nozzles 10 are arrayed at predetermined intervals and connected to an ink tank (not shown) for reserving a functional liquid material (ink).

Similarly to the above, the inkjet head 14 is integrally fixed to the head holder 35, and a slit-like space 37 is formed inside the head holder 35. The slit-like space 37 is forked at the lower part and opened to the lower surface 35*a* of the head holder 35, and a slit-like suction port 36 is formed between the head holder 35 and each of the inkjet heads 14 on both sides.

The lower surface 35*a* of the head holder 35 is disposed to protrude from the lower surface 14*a* of the inkjet head 14 by a slight distance G (for example, about 300 μm), whereby a wall part is formed on the side opposite the nozzles 10 with respect to the suction port 36. Also, similarly to the ink suction means 23 shown in FIG. 3, the slit-like space 37 is, by using a pipe 19 connected thereto, connected to a suction pump 22 through a trap vessel 20 and a filter 21.

As described above, the suction port 36 is formed between the head holder 35 and the inkjet head 14, so that the suction port 36 can be made to face toward the direction of the nozzle 10 by a simple construction and moreover, can be disposed very close thereto.

At the image formation of ejecting a functional liquid material (ink) from the nozzles 10, the suction pump 22 is actuated and air in the vicinity of the nozzles 10 is suctioned from the suction port 36, whereby the fine ink mist floating in the vicinity of the nozzles 10 or recording medium S or the ink adhered to the inkjet head 14 is suctioned together with the air and recovered in the trap vessel 20.

At this time, the lower surface 35*a* of the head holder 35 is protruding downward from the lower surface 14*a* of the inkjet head 14 by a slight distance G and therefore, the air in the vicinity of the nozzles 10, which is to be suctioned from the suction port 36, is suctioned in the arrow C direction, as a result, the ink mist recovery efficiency is enhanced.

By virtue of such a construction, not only troubles such as misdirected ejection, no ejection, change of ejection amount and ink dripping, for which adhering ink attributable to ink mist and attached on the inkjet head 14 is responsible, can be prevented and the image quality can be enhanced, but also the contamination inside and outside the inkjet recording apparatus 110 can be prevented. Other constitutions, functions and operations are the same as those of the inkjet recording apparatus 110 of the first embodiment.

Third Embodiment

The head unit of the third embodiment is described below by referring to FIG. 8. In the head unit of the third embodiment, the nozzles and the suction port disposed in parallel with the line of nozzles are integrally arranged in the head unit. FIG. 7 is a perspective view seeing the head unit of the third embodiment from below.

Incidentally, since the third embodiment is the same as the inkjet recording apparatus 100 of the first embodiment described above except that the suction port and the nozzles are integrally arranged in the head unit, only the head unit is shown.

Figure 8:
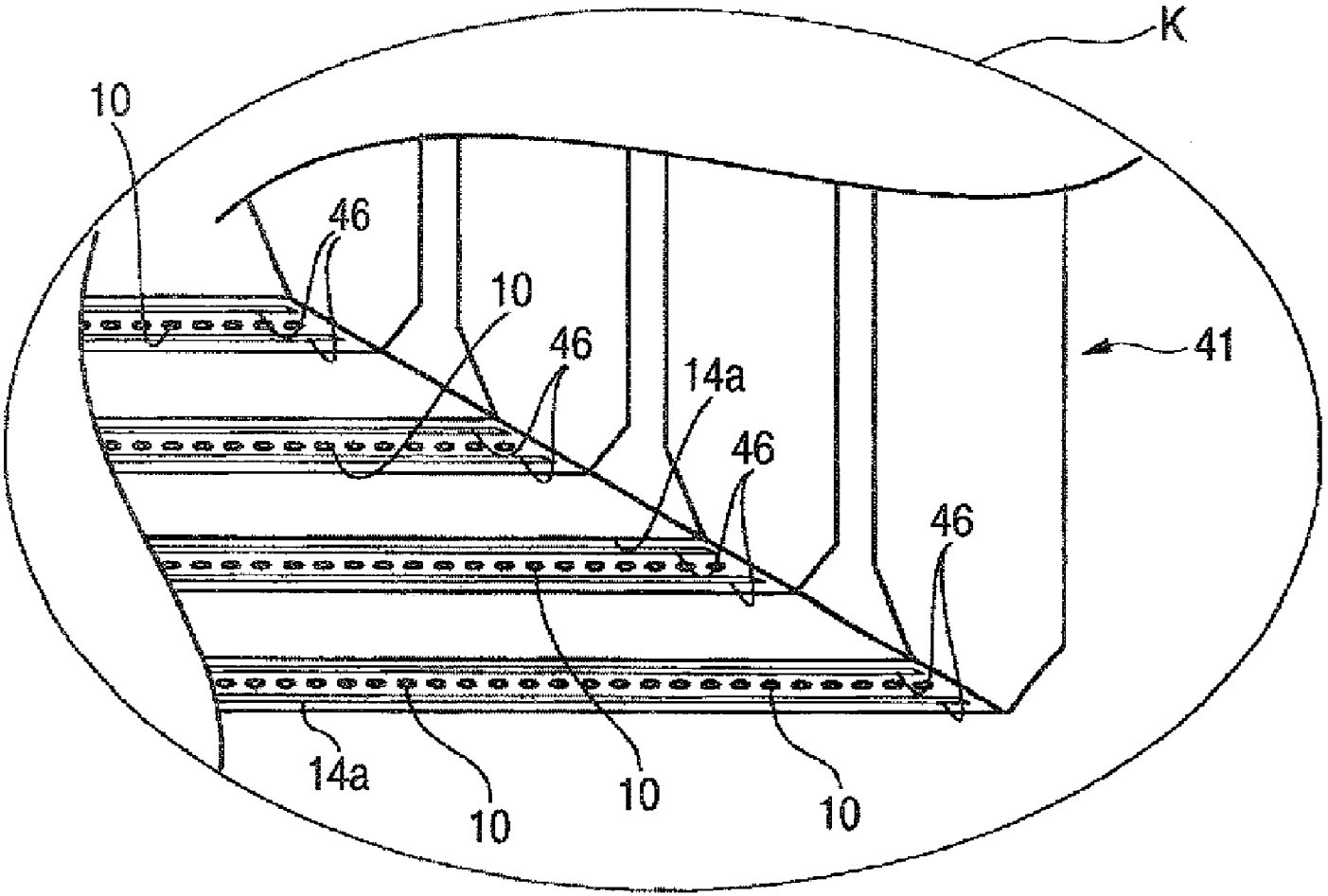
FIG. 8 is a perspective view seeing the head unit of the third embodiment from below.

As shown in FIG. 8, in the head unit 41 of the third embodiment, similarly to the inkjet head 14 of the first embodiment, a large number of nozzles 10 are arrayed at predetermined intervals and connected to an ink tank (not shown) for reserving a functional liquid material (ink).

On the lower surface 14*a* of the inkjet head 14, before and after the nozzles 10 (in the direction orthogonal to the array direction of nozzles 10), two slit-like suction ports 46 disposed in parallel with and in the vicinity of the line of nozzles 10 are arranged at the distal end of the inkjet head 14. The slit-like suction port 46 is, similarly to the ink suction means 23 shown in FIG. 3, connected to a suction pump 22 through a trap vessel 20 and a filter 21. Incidentally, two suction ports 46 need not be always provided to sandwich the nozzles 10 but may be provided in parallel only on one side of the nozzle 10.

While ejecting a functional liquid material (ink) from the nozzles 10, the suction pump 22 is actuated and air in the vicinity of the nozzles 10 is suctioned from the suction port 46, whereby the ink mist or the ink adhered to the inkjet head 14 is suctioned and removed and troubles such as misdirected ejection, no ejection, change of ejection amount and ink dripping, for which adhering ink is responsible, can be prevented. Incidentally, the suction port 46 need not necessarily have a slit shape but may be composed of, for example, a large number of small holes disposed in parallel with the array direction of nozzles 10.

Other constitutions, functions and operations are the same as those of the inkjet recording apparatus 100 of the first embodiment, and description thereof is omitted here.

In the embodiments described above, the inkjet recording apparatus is a full line-type recording apparatus but is not limited thereto and may be a recording apparatus of other modes. Also, the ink is not limited to an ultraviolet curable functional material and other kinds of ink may be similarly applied.

Furthermore, the recording medium and functional liquid material used for recording an image by the inkjet recording apparatus of these embodiments are not limited to paper and ink. For example, an apparatus of ejecting ink on a polymer film or glass to produce a color filter for displays, or ejecting a solder in the weld state on a substrate to form a bump for component mounting, may also be fabricated.

The "active energy" as used in the present invention is not particularly limited as long as energy capable of generating an initiation seed in the ink composition can be imparted upon irradiation, and widely includes α-ray, γ-ray, X-ray, ultraviolet ray, visible ray, electron beam and the like. Among these, in view of curing sensitivity and easy availability of the apparatus, ultraviolet ray and electron beam are preferred, and ultraviolet ray is more preferred. Accordingly, the ink composition for use in the present invention is preferably an ink composition capable of being cured by the irradiation of ultraviolet ray.

In the inkjet recording apparatus of the present invention, the peak wavelength of active energy varies depending on the absorption characteristics of the sensitizing dye in the ink composition but is suitably, for example, from 200 to 600 nm, preferably from 300 to 450 nm, more preferably from 350 to 450 nm. Also, the (a) electron transfer-type initiation system of the ink composition for use in the present invention exhibits sufficiently high sensitivity even with low-output active energy. Accordingly, the output of the active energy used as the irradiation energy is suitably, for example, 2,000 mJ/cm$^2$ or less, preferably from 10 to 2,000 mJ/cm$^2$ more preferably from 20 to 1,000 mJ/cm$^2$, still more preferably from 50 to 800 mJ/cm$^2$. Also, the active energy is suitably irradiated at an exposure surface illuminance (a maximum illuminance on the recording medium surface) of, for example, from 10 to 2,000 mW/cm$^2$, preferably from 20 to 1,000 mW/cm$^2$.

Particularly, in the inkjet recording apparatus of the present invention, the active energy is preferably irradiated from a light-emitting diode capable of generating an ultraviolet ray giving an emission wavelength peak of 390 to 420 nm and a maximum illuminance of 10 to 1,000 mW/cm$^2$ on the recording medium surface.

Also, in the inkjet recording apparatus of the present invention, the active energy is suitably made to irradiate the ink composition ejected on a recording medium, for example, for 0.01 to 120 seconds, preferably from 0.1 to 90 seconds.

Furthermore, in the inkjet recording apparatus of the present invention, it is preferred that the ink composition is heated to a fixed temperature and the time from the landing of ink composition on a recording medium to the irradiation of active energy is set to 0.01 to 0.5 seconds, preferably from 0.02 to 0.3 seconds, more preferably from 0.03 to 0.15 seconds. By controlling the time from the landing of ink composition on a recording medium to the irradiation of active energy to such a very short timer the ink composition landed can be prevented from bleeding before being cured.

For obtaining a color image by using the inkjet recording apparatus of the present invention, the colors are preferably superposed in the color value order from lower to higher. When superposed in such an order, the active energy can readily reach the ink in the lower part and this can be expected to yield good curing sensitivity, reduction of residual monomer, decrease of odor and enhancement of adhesive property.

As for the irradiation of active energy, all colors may be shot and en bloc exposed, but exposure is preferably performed every each color in view of curing acceleration.

As described above, in the case of active energy curable ink like the ink composition of the present invention, the ink composition ejected is preferably heated to a fixed temperature and therefore, the region from the ink supply tank to the inkjet head portion is preferably under the temperature control by heat insulation and heating. Also, the head unit is preferably heated by thermally shielding or insulating the apparatus body so as to prevent the effect from the temperature of the outer air. In order to shorten the printer start-up time necessary for heating or reduce the loss of heat energy, in combination with thermal insulation from other sites, the heat capacity of the entire heating unit is preferably made small.

As for the active energy source, a mercury lamp, a gas/solid laser and the like are principally utilized and for the ultraviolet curing-type inkjet, a mercury lamp and a metal halide lamp are widely known. Furthermore, replacement by a GaN-based semiconductor ultraviolet light-emitting device is industrially and environmentally very useful. In addition, LED (UV-LED) and LD (UV-LD) are compact, long-lived, highly efficient and low costing and are promising as a radiation source for active energy curing-type inkjet.

As described above, a light-emitting diode (LED) and a laser diode (LD) may be used as the active energy source. In particular, when an ultraviolet source is necessary, an ultraviolet LED and ultraviolet LD can be used. For example, an ultraviolet LED of which main emission spectrum has a wavelength between 365 nm and 420 nm is commercially available from Nichia Corp. Also, when a further shorter wavelength is necessary, an LED capable of emitting active energy having a primary emission between 300 nm and 370 nm is disclosed in U.S. Pat. No. 6,084,250. Other ultraviolet LEDs are also available, and radiations in different ultraviolet bands may be irradiated. The active energy source for use in the present invention is preferably UV-LED, more preferably UV-LED having a peak wavelength in the region of 350 to 420 mm.

(Recording Medium)

The recording medium to which the ink composition of the present invention can be applied is not particularly limited and normal paper sheets such as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film and TAC film. Other examples of the plastic usable as the recording medium material include polycarbonate, acrylic resin, ABS, polyacetal, PVA and rubbers. Furthermore, metals and glasses may also be used as the recording medium.

In the ink composition of the present invention, when a material less causing heat shrinkage at curing is selected, excellent adhesive property is obtained between the cured ink composition and the recording medium and this is advantageous in that a high-definition image can be formed even on a film susceptible to curling or deformation due to, for example, curing shrinkage of ink or heat generation at the curing reaction, such as PET film, OPS film, OPP film, ONy film and PVC film which are thermally shrinkable.

The constituent components for use in the ink composition usable in the present invention are described in sequence.

(Ink Composition)

The ink composition for use in the present invention is an ink composition capable of being cured by the irradiation of active energy, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound, (b) a compound capable of generating an acid upon irradiation with active energy, and (c) a colorant and if desired, may further contain an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described in sequence below.

((a) Cationic Polymerizable Compound)

The (a) cationic polymerizable compound for use in the present invention is not particularly limited as long as it is a compound capable of being cured by causing a polymerization reaction with use of an acid generated from the (b) compound capable of generating an acid upon irradiation with active energy, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31892, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene oxide, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, represented by a diglycidyl ether of a polyethylene glycol or an alkylene oxide adduct thereof, and a diglycidyl ether of a polypropylene glycol or an alkylene oxide adduct thereof. Examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxycyclohexyl-5,5-spiro-3,4-epoxy)cyclohexane-m-dioxane, bis-(3,4-epoxycyclohexylmethyl) adipate, vinylcyclohexene oxide, 4-vinylepoxycyclohexane, bis(3,4-epoxy-6-methylcyclohexylmethyl)adipate, 3,4-epoxy-6-methylcyclohexyl-3',4'-epoxy-6'-methylcyclohexane carboxylate, methylenebis(3,4-epoxycyclohexane), dicyclopentadiene diepoxide, di(3,4-epoxycyclohexylmethyl) ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chlorcethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesive property to the recording medium, surface hardness of the image formed, or the like, and a divinyl ether compound is more preferred.

The oxetane compound as referred to in the present invention indicates a compound having an oxetane ring, and known oxetane compounds described in JP-A-2001-220526, JP-A-2001310937 and JP-A-2003-341217 may be arbitrarily selected and used.

The compound having an oxetane ring which can be used in the ink composition of the present invention is preferably a compound having from one to four oxetane rings in the structure thereof. When such a compound is used, the viscosity of the ink composition can be easily maintained in a range allowing for good handling, and high adhesive property can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage at the curing of ink, at least one compound selected from an oxetane compound and an epoxy compound is preferably used in combination with a vinyl ether compound.

The content of the (a) cationic polymerizable compound in the ink composition is suitably from 10 to 95 masse, preferably from 30 to 90 mass %, more preferably from 50 to 85 mass %, based on the entire solid content of the composition.

((b) Compound Capable of Generating an Acid Upon Irradiation with Active Energy)

The ink composition of the present invention contains a compound capable of generating an acid upon irradiation with active energy (hereinafter appropriately referred to as a "photoacid generator").

As for the photoacid generator which can be used in the present invention, compounds capable of generating an acid upon irradiation with light (ultraviolet ray or far ultraviolet ray of 400 to 200 nm, preferably g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like, may be appropriately selected and used.

Examples of such a photoacid generator include an onium salt such as diazonium salt, ammonium salt, phosphonium salt, iodonium salt, sulfonium salt, selenonium salt and arsonium salt, an organic halogen compound, an organic metal/organic halide, an o-nitrobenzyl type protective group-containing photoacid generator, a compound capable of undergoing photodecomposition to generate a sulfonic acid as represented by imino sulfonate, a disulfone compound, a diazoketosulfone and a diazodisulfone compound, which each decomposes upon irradiation with active energy to generate an acid.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to [0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 mass %, more preferably from 0.5 to 10 mass %, still more preferably from 1 to 7 mass %, in terms of the entire solid content of the ink composition.

((c) Colorant)

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As for the dye, both a water-soluble dye and an oil-soluble dye may be used, but an oil-soluble dye is preferred.

(Pigment)

The pigment which is preferably used in the present invention is described below.

The pigment is not particularly limited and, for example, all organic and inorganic pigments generally available on the market, those obtained by dispersing a pigment in a dispersion medium such as insoluble resin, and those obtained by grafting a resin on the pigment surface may be used. In addition, those obtained by, for example, dyeing a resin particle with a dye may also be used.

Examples of such a pigment include pigments described in Seishiro Ito (compiler) *Ganryo No Jiten* (*Pigment Dictionary*) published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are described below. Examples of the pigment which provides a yellow color include a monoazo pigment such as C.I. Pigment Yellow 1 (e.g., Fast Yellow G) and C.I. Pigment Yellow 74; a disazo pigment such as C.I. Pigment Yellow 12 (e.g., Disazo Yellow AAA) and C.I. Pigment Yellow 17; a non-benzidine-based azo pigment such as C.I. Pigment Yellow 180; an azo lake pigment such as C.I. Pigment Yellow 100 (e.g. Tartrazine Yellow Lake); a condensed azo pigment such as C.I. Pigment Yellow 95 (e.g., Condensed Azo Yellow GR); an acid dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139) a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acid dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraguinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C.I. Pigment Violet 19 (unsubstituted quinacridone) and C.I. Pigment Red 122 (e.g., Quinacridone Magenta); an isoindolinone pigment such as C.I. Pigment Red 180 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g. Phthalocyanine Blue); an acid dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C.I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, the titanium oxide ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic homogenizer, pearl mill and wet jet mill.

When dispersing the pigment, a dispersant may also be added. Examples of the dispersant include a hydroxyl group-containing carboxylic acid ester, a salt of long-chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by mass per 100 parts by mass of the pigment.

In the ink composition, a solvent may be added as a dispersion medium for various components such as pigment, or the (a) cationic polymerizable compound which is a low molecular weight component may be used as a dispersion medium without using a solvent. However, since the ink composition of the present invention is an active energy curable ink and after applying on the recording medium, the ink is cured, the ink composition is preferably solvent-free. This is because when the solvent remains in the cured ink image, the solvent resistance may deteriorate or the residual solvent may cause a problem of VOC (volatile organic compound). From such a standpoint, the (a) cationic polymerizable compound is preferably used as the dispersion medium. Particularly, in view of dispersion suitability or enhancement of handling property of the ink composition, a cationic polymerizable monomer having a lowest viscosity is preferably selected.

The average particle diameter of the pigment is preferably from 0.02 to 4 Urn, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of a head nozzle can be restrained, and the storage stability of ink and the transparency and curing sensitivity of ink can be maintained.

(Dye)

The dye for use in the present invention is preferably an oil-soluble dye. Specifically, the oil-soluble dye means a dye having a solubility in water at 25° C. (mass of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving fading, particularly resistance to an oxidizing substance such as ozone or curing characteristics, the oxidation potential is preferably noble (high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-I) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent document above may be used not only for yellow ink but also for ink of any color such as black ink and red ink.

As for the dye of magenta color, compounds having a structure represented by formulae (3) and (4) described in JP-A-2002-114930 are preferred. Specific examples thereof include compounds described in paragraphs [0054] to [0073] of JP-A-2002-114930.

Azo dyes represented by formulae (M-1) to (M-2) described in paragraphs [0084] to [0122] of JP-A-2002-121414 are more preferred, and specific examples thereof include compounds described in paragraphs [0123] to [0132] of JP-A-2002-121414. Incidentally, the oil-soluble dyes of formulae (3), (4) and (M-1) to (M-2) described in these patent documents may be used not only for magenta ink but for ink of any color such as black ink and red ink.

As for the dye of cyan color, dyes represented by formulae (I) to (IV) of JP-A-2001-181547 and dyes represented by formulae (IV-1) to (IV-4) described in paragraphs [0063] to [0078] of JP-A-2002-121414 are preferred. Specific examples thereof include compounds described in paragraphs [0052] to [0066] of JP-A-2001-181547 and compounds described in paragraphs [0079] to of JP-A-2002-121414.

Phthalocyanine dyes represented by formulae (C-I) and (C-II) described in paragraphs [0133] to [0196] of JP-A-2002-121414 are more preferred, and the phthalocyanine dye represented by formula (C-II) is still more preferred. Specific examples thereof include compounds described in paragraphs [0198] to [0201] of JP-A-2002-121414. Incidentally, the oil-soluble dyes of formulae (I) to (IV), (IV-1) to (IV-4), (C-I) and (C-II) may be used not only for cyan ink but also for ink of any color such as black ink and green ink.

Such a colorant is preferably added in an amount of, in terms of solid content, from 1 to 20 mass %, more preferably from 2 to 10 mass %, based on the ink composition.

In the ink composition of the present invention, in addition to the above-described essential components, various additives may be used in combination according to the purpose. These arbitrary components are described below.

(Ultraviolet Absorbent)

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057; benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazine-based compounds described in JP-A-4-298503, JP-A-8-53427, JP-A-8-239368, JP-A-10-182621 and JP-T-8-501291 (the term (the term "JP-T" as used herein means a "published Japanese translation of a PCT patent application"); compounds described in *Research Disclosure*, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 mass % in terms of solid content.

(Sensitizer)

In the ink composition of the present invention, if desired, a sensitizer may be added for the purpose of enhancing the acid generation efficiency of the photoacid generator and shifting the photosensitive wavelength to a long wavelength side. The sensitizer may be sufficient if it can sensitize the photoacid generator by an electron or energy transfer mechanism. Preferred examples thereof include an aromatic polycondensed ring compound such as anthracene, 9,10-dialkoxyanthracene, pyrene and perylene; an aromatic ketone compound such as acetophenone, henzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

(Antioxidant)

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459-416, German Unexamined Patent Publication No. 3435443, JP-A-54-48535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,980,275.

The amount of the antioxidant added is appropriately selected according to the purpose but is generally on the order of 0.1 to 8 mass % in terms of the solid content.

(Anti-fading Agent)

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxyanilines and heterocyclic compounds. Examples of the metal complex-based anti-fading agent include a nickel complex and a zinc complex, and specifically, there may be used compounds described in patents cited in *Research Disclosure*, No. 17643, No. VII, Items I to J, ibid. No. 15162, ibid., No. 18716, page 650, left column, ibid., No. 36544, page 527, ibid., No. 307105, page 872, and ibid., No. 15162; and compounds included in formulae of representative compounds and in examples of the compounds describe on JP-A-62-215272, pp. 127-137.

The amount of the anti-fading agent added is appropriately selected according to the purpose but is generally on the order of 0.1 to 8 mass % in terms of the solid content.

(Electrically Conducting Salts)

In the ink composition of the present invention, electrically conducting salts such as potassium thiocyanate, lithium nitrate, ammonium thiocyanate and dimethylamine hydrochloride may be added for the purpose of controlling physical properties on shooting.

(Solvent)

In the ink composition of the present invention, addition of an organic solvent in an extremely small amount is also effective for the purpose of improving the adhesive property to the recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate; an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 mass %, more preferably from 0.1 to 3 mass %, based on the entire ink composition.

(Polymer Compound)

In the ink composition of the present invention, various polymer compounds may be added for the purpose of adjusting the physical properties of film. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of polymer binder, a copolymer containing, as the structural unit, a "carboxyl group-containing monomer", an "alkyl methacrylate" or an "alkyl acrylate" is also preferably used.

(Surfactant)

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylaryl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant. The organic fluoro compound is preferably hydrophobic. Examples of the organic fluoro compound include a fluorine-based surfactant, an oily fluorine-based compound (e.g., fluorine oil), a solid fluorine compound resin (e.g., tetrafluoroethylene resin) and those described in JP-B-57-9053 (columns 8 to 17) and JP-A-62-135826.

Other than these, for example, a leveling additive, a matting agent, waxes for adjusting the physical properties of film, and a tackifier for improving adhesive property to a recording medium such as polyolefin and PET, which does not hinder the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

(Radical Polymerization-Type Ink Composition)

The radical polymerization-type ink composition contains (d) a radical polymerizable compound, (e) a polymerization initiator and (f) a colorant and, if desired, may further contain a sensitizing dye, a co-sensitizer and the like.

The constituent components used in the radical polymerization-type ink composition described in sequence below.

(d) (Radical Polymerizable Compound)

The radical polymerizable compound includes, for example, the following compound having an addition-polymerizable ethylenically unsaturated bond.

(Compound Having Addition-Polymerizable Ethylenically Unsaturated Bond)

Examples of the compound having an addition-polymerizable ethylenically unsaturated bond, which can be used in the ink composition of the present invention include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyhydric amine compound.

Specific examples of the ester monomer of an aliphatic polyhydric alcohol compound and an unsaturated carboxylic acid include the followings. Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl) ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl) isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy) phenyl]dimethylmethane, and bis[p-(acryloxyethoxy)phenyl]-dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diltaconate, and sorbitol tetraitaconate.

Examples of the crotonic acid ester include ethylene glycol dicrotonate, tetramethylene glycol dicrotonate, pentaerythritol dicrotonate, and sorbitol tetradicrotonate. Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 176-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by formula (A) to a polyisocyanate compound containing two or more isocyanate groups within one molecule, described in JP-B-48-41708: $CH_2{=}C(R)COOCH_2CH(R')OH$ (A) (wherein R and R' each represents H or $CH_3$).

Still other examples include a functional acrylate or methacrylate such as urethane acrylates described in JP-A-51-37193; polyester acrylates described in JP-A-48-64183, JP-B-49-43191 and JP-B-52-30490; and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may be used. In the present invention, these monomers can be used in a chemical form such as a prepolymer, namely, dimer, trimer or oligomer, or a mixture or copolymer thereof.

The amount of the radical polymerizable compound used is usually from 1 to 99.99%, preferably from 5 to 90.0%, more preferably from 10 to 70% ("%" as used herein indicates "mass %"), based on all components of the ink composition.

(e) (Photopolymerization Initiator)

The photopolymerization initiator for use in the radical polymerization-type ink composition of the present invention is described below.

The photopolymerization initiator as used in the present invention is a compound capable of generating a chemical change through action of light or interaction with the electron excited state of sensitizing dye to produce at least one species of a radical, an acid and a base.

Preferred examples of the photopolymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

(f) (Colorant)

A colorant the same as those described for the (c) colorant regarding the cationic polymerization-type ink composition may be utilized.

In the ink composition of the present invention, in addition to the above-described essential components, various additives may be used in combination according to the purpose. These arbitrary components are described below.

(Sensitizing Dye)

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B, Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine orange, chloroflavin, acriflavine) anthraquinones (e.g., anthraquinone), squaryliums (e.g., squarylium), and coumarins (e.g., 7-diethylamino-4-methylcoumarin).

(Co-sensitizer)

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-5182102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzothiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyl tin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for inkjet recording of the present invention is preferably shot after heating it in a range from 40 to 80° C. to decrease the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

(Others)

In addition, known compounds may be used as needed. For example, a surfactant, a leveling additive, a matting agent and, for adjusting the physical properties of film, a polyester-based resin, a polyurethane-based resin, a vinyl based resin, an acryl-based resin, a rubber-based resin or waxes, may be appropriately selected and used. Furthermore, in order to improve the adhesive property to a recording medium such as polyolefin and PET, a tackifier which does not inhibit the polymerization is also preferably added. Specific examples thereof include high molecular weight adhesive polymers described in JP-A-2001-49200, pp. 5-6 (for example, a copolymer comprising an ester of a (meth) acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to the recording medium. In this case, addition in the range of not causing a problem in the solvent resistance or VOC is effective, and this amount is preferably from 0.1 to 5 mass %, more preferably from 0.1 to 3 mass %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

(Aqueous Ink Composition)

The aqueous ink composition contains a polymerizable compound and a water-soluble photopolymerization initiator capable of generating a radical by the action of active energy and if desired, may further contain a coloring material and the like.

(Polymerizable Compound)

As for the polymerizable compound contained in the aqueous ink composition of the present invention, polymerizable compounds contained in known aqueous ink compositions may be used.

In the aqueous ink composition, a reactive material may be added so as to optimize the formulation by taking into account end user characteristics such as curing rate, adhesive property and flexibility. For example, a (meth)acrylate (namely, acrylate and/or methacrylate) monomer or oligomer, an epoxide and an oxetane are used as such a reactive material.

Examples of the acrylate monomer include phenoxyethyl acrylate, octyldecyl acrylate, tetrahydrofuryl acrylate, isobornyl acrylate, hexanediol diacrylate, trimethylolpropane triacrylate, pentaerythritol triacrylate, polyethylene glycol diacrylate (e.g., tetraethylene glycol diacrylate), dipropylene glycol diacrylate, tri(propylene glycol) triacrylate, neopentyl glycol diacrylate, bis(pentaerythritol) hexaacrylate, an acrylate of an ethoxylated or propoxylated glycol and a polyol (e.g., propoxylated neopentyl glycol diacrylate, ethoxylated trimethylolpropane triacrylate), and a mixture thereof.

Examples of the acrylate oligomer include ethoxylated polyethylene glycol, ethoxylated trimethylolpropane acrylate, polyether acrylate including an ethoxylated product thereof, and urethane acrylate oligomer.

Examples of the methacrylate include hexanediol dimethacrylate, trimethylolpropane trimethacrylate, triethylene glycol dimethacrylate, diethylene glycol dimethacrylate, ethylene glycol dimethacrylate, 1,4-butanediol dimethacrylate, and a mixture thereof.

The amount of the oligomer added is preferably from 1 to 80 wt %, more preferably from 1 to 10 wt %, based on the entire weight of the ink composition.

(Water-Soluble Photopolymerization Initiator Capable of Producing a Radical by the Action of Active Energy)

The polymerization initiator which can be used in the ink composition of the present invention is described. As one example, a photopolymerization initiators having a wavelength of approximately 400 nm may be used. Examples of such a photopolymerization initiator include photopolymerization initiators represented by the following formulae, which are a substance having functionality in a long wavelength region, namely, sensitivity of producing a radical when irradiated with ultraviolet rays (hereinafter simply referred to as a "TX system"). In the present invention, particularly, a photopolymerization initiator appropriately selected from these is preferably used.

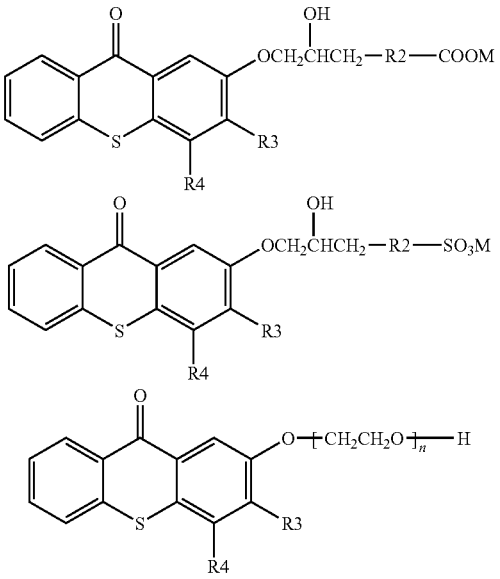

In formulae TX-1 to TX-3, R2 represents —$(CH_2)_x$— (wherein x is 0 or 1), —O— $(CH_2)_y$— (wherein y is 1 or 2), or a substituted or unsubstituted phenylene group. When R2 is a phenylene group, at least one of hydrogen atoms in the benzene ring may be substituted by one group or atom or two or more groups or atoms selected from, for example, a carboxyl group or a salt thereof, a sulfonic acid or a salt thereof, a linear or branched alkyl group having from a carbon number of 1 to 4, a halogen atom (e.g., fluorine, chlorine, bromine), an alkoxyl group having a carbon number of 1 to 4, and an aryloxy group such as phenoxy group. M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine atom, chlorine atom, bromine atom), a hydroxyl group, and an alkoxyl group (having a carbon number of approximately from 1 to 3). m represents an integer of 1 to 10.

In the present invention, a water-soluble derivative of a photopolymerization initiator, Irgacure 2959 (trade name, produced by Ciba Specialty Chemicals), represented by the following formula (hereinafter simply referred to as an "IC system") may be used Specifically, IC-1 to IC-3 of the following formulae may be used.

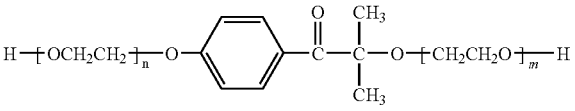

(n: 2 to 5, m: 0 to 5)

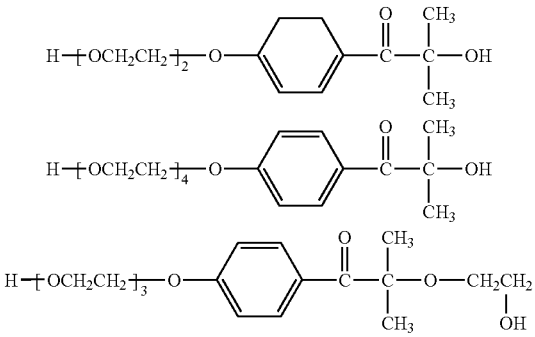

(Formulation for Clear Ink)

By using the water-soluble polymerizable compound in the form of a transparent aqueous ink without incorporating the coloring material, a clear ink can be prepared. In particular, by preparing the ink to have inkjet recording characteristics, an aqueous photocuring-type clear ink for inkjet recording is obtained. When such an ink is used, since it does not contain a coloring material, a clear film can be obtained. Examples of the usage of the coloring material-free clear ink include use for the undercoating to impart suitability for image printing to a recording material, and use for the overcoating to protect the surface of an image formed by a normal ink or further impart decoration, gloss or the like. In the clear ink, a colorless pigment, fine particle or the like not for the purpose of coloration may be incorporated by dispersion according to these uses. By this addition, various characteristics such as image quality, fastness and processability (handling property) of a printed matter can be enhanced in either case of undercoating or overcoating.

As for the formulation conditions in such application to a clear ink, the ink is preferably prepared to contain a water-soluble polymerizable compound as the main component of the ink in a proportion of 10 to 85% and a photopolymerization initiator (for example, an ultraviolet polymerization catalyst) in an amount of 1 to 10 parts by mass per 100 parts by mass of the water-soluble polymerizable compound and at the same time, contain a photopolymerization initiator in an amount of at least 0.5 parts per 100 parts of the ink.

(Material Construction in Coloring Material-Containing Ink)

In the case of using the water-soluble polymerizable compound for a coloring material-containing ink, the concentrations of the polymerization initiator and polymerizable substance in the ink are preferably adjusted according to the absorption characteristics of the coloring material contained. As described above, with respect to the blending amount, the amount of water or solvent is set to be, on the mass basis, from 40 to 90%, preferably from 60 to 75%. Also, the content of the polymerizable compound in the ink is set to be, on the mass basis, from 1 to 30%, preferably from 5 to 20%, based on the entire amount of the ink. The amount of the polymerization initiator depends on the content of the polymerizable compound but is generally, on the mass basis, from 0.1 to 7%, preferably from 0.3 to 5%, based on the entire amount of the ink.

In the case where a pigment is used as the coloring material of the ink, the concentration of the pure pigment portion in the ink is generally from 0.3 to 10 mass % based on the entire amount of the ink. The coloring power of the pigment depends on the dispersed state of pigment particles, but when the concentration is approximately from 0.3 to 1%, the ink is used as a pale-color ink, whereas the concentration exceeding this range gives a concentration employed for normal coloration.

(Preferred Physical Properties of Ink Composition)

Taking into account the shooting property, the ink viscosity of the ink composition of the present invention is preferably 20 mPa·s or less, more preferably 10 mPa·s or less, at the shooting temperature, and an appropriate compositional ratio is preferably determined to give an ink viscosity in this range.

The surface tension in common of the ink composition of the present invention is preferably from 20 to 40 mN/m, more preferably from 25 to 35 mN/m. In the case of recording an image on various recording mediums such as polyolefins, PET, coated paper and non-coated paper, the surface tension is preferably 20 mN/m or more in view of bleeding and penetration and is preferably 40 mN/m or less in view of wettability.

The thus-adjusted ink composition of the present invention is suitably used as an ink for inkjet recording. In the case of using the ink composition as an ink for inkjet recording, the ink composition is shot on a recording medium by an inkjet printer and the ink composition shot is then cured by irradiating thereon active energy, thereby performing the recording.

The printed matter obtained by using this ink has an image area cured by the irradiation with active energy such as ultraviolet ray and is assured of excellent strength of the image area and therefore, the ink composition can be used for various uses such as formation of an ink-receiving layer (image area) of a lithographic printing plate, other than the formation of an image.

The present application claims foreign priority based on Japanese Patent Application (JP 2006-095471) filed Mar. 3, 2006 the contents of which is incorporated herein by reference.

What is claimed is:

1. An inkjet recording apparatus comprising:

a plurality of inkjet heads having nozzles ejecting a functional liquid material on a recording medium;

a head holder fixing the plurality of inkjet heads at predetermined intervals; and an ink suction unit that has a suction port disposed in the vicinity of the nozzles thereof, wherein the suction port is positioned at a plane including a lower surface of the inkjet head, wherein the suction port is disposed in each of the plurality of inkjet heads.

2. The inkjet recording apparatus as claimed in claim 1, wherein the suction port has the function to vacuum ink.

3. An inkjet recording apparatus comprising:

a plurality of inkjet heads having nozzles ejecting a functional liquid material on a recording medium;

a head holder fixing the plurality of inkjet heads at predetermined intervals; and an ink suction unit that has a suction port disposed in the vicinity of the nozzles thereof, wherein the suction port is positioned at a plane including a lower surface of the inkjet head, wherein the suction port is disposed in the head holder.

4. The inkjet recording apparatus as claimed in claim 3, wherein the suction port has the function to vacuum ink.

5. An inkjet recording apparatus comprising:

a plurality of inkjet heads having nozzles ejecting a functional liquid material on a recording medium;

a head holder fixing the plurality of inkjet heads at predetermined intervals; and an ink suction unit that has a suction port disposed in the vicinity of the nozzles thereof, wherein the suction port is positioned at a plane including a lower surface of the inkjet head, wherein the suction port is disposed at a borderline region contacting with the head holder and the each of the plurality of inkjet heads.

6. The inkjet recording apparatus as claimed in claim 5, wherein the suction port has the function to vacuum ink.

7. An inkjet recording apparatus comprising:

a plurality of inkjet heads having nozzles ejecting a functional liquid material on a recording medium;

a head holder fixing the plurality of inkjet heads at predetermined intervals; and an ink suction unit that has a suction port disposed in the vicinity of the nozzles thereof, wherein the suction port is positioned at a plane including a lower surface of the inkjet head, wherein the suction port is arranged on a member on which the nozzles are provided.

8. The inkjet recording apparatus as claimed in claim 7, wherein the suction port has the function to vacuum ink.

* * * * *